US011214080B2

(12) United States Patent
Tamai et al.

(10) Patent No.: US 11,214,080 B2
(45) Date of Patent: Jan. 4, 2022

(54) RECORDING DEVICE

(71) Applicant: SEIKO EPSON CORPORATION, Tokyo (JP)

(72) Inventors: Satoshi Tamai, Matsumoto (JP); Takao Oizumi, Matsumoto (JP); Yuki Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 153 days.

(21) Appl. No.: 16/810,303

(22) Filed: Mar. 5, 2020

(65) Prior Publication Data

US 2020/0282750 A1 Sep. 10, 2020

(30) Foreign Application Priority Data

Mar. 8, 2019 (JP) ..... JP2019-042324
Oct. 25, 2019 (JP) ..... JP2019-194111

(51) Int. Cl.
*B41J 11/58* (2006.01)
*B41J 11/00* (2006.01)
*B41J 13/10* (2006.01)

(52) U.S. Cl.
CPC ..... *B41J 11/58* (2013.01); *B41J 11/007* (2013.01); *B41J 13/103* (2013.01); *B41J 13/106* (2013.01)

(58) Field of Classification Search
CPC ..... B65H 2405/324; B65H 2405/11164; B41J 13/106; B41J 13/10; B41J 13/103; B41J 11/0045; G03G 15/6552
See application file for complete search history.

(56) References Cited

U.S. PATENT DOCUMENTS 4,748,457 A * 5/1988 Quedens ..... G01D 15/24 346/136
6,595,514 B2 * 7/2003 Takahashi ..... G03G 15/6514 271/162
8,272,637 B2 * 9/2012 Asada ..... B65H 31/02 271/171
8,672,429 B2 * 3/2014 Ishida ..... B65H 31/02 312/223.1
2006/0001209 A1 * 1/2006 Takagi ..... B65H 31/02 271/3.14

(Continued)

FOREIGN PATENT DOCUMENTS

JP 2003-095512 4/2003
JP 2007-290801 11/2007
JP 2009-046271 3/2009

*Primary Examiner* — John Zimmermann
(74) *Attorney, Agent, or Firm* — Workman Nydegger

(57) ABSTRACT

A medium receiving tray is configured to switch between a first state in which the medium receiving tray is accommodated in a device main body and a second state in which the medium receiving tray most protrudes, and the device main body includes a support member that is configured to be support the medium receiving tray. The device main body includes a rail that supports the first tray constituting the medium receiving tray. The support member is at a position protruding from an end portion of the rail in a protruding direction of the first tray from the device main body. The support member is at the retracted position when the medium receiving tray is in the first state, is at the advanced position when the medium receiving tray is in the second state, and supports the first tray constituting the medium receiving tray from below.

10 Claims, 16 Drawing Sheets

(56) References Cited

U.S. PATENT DOCUMENTS

| | | | | |
|---|---|---|---|---|
| 2006/0017794 | A1* | 1/2006 | Kinoshita | B41J 13/103<br>347/104 |
| 2014/0103603 | A1* | 4/2014 | Horita | B65H 5/062<br>271/171 |

* cited by examiner

RECORDING DEVICE

The present application is based on, and claims priority from JP Application Serial Number 2019-042324, filed Mar. 8, 2019 and JP Application Serial Number 2019-194111, filed Oct. 25, 2019, the disclosures of which are hereby incorporated by reference herein in their entirety.

BACKGROUND

1. Technical Field

The present disclosure relates to a recording device that performs recording on a medium.

2. Related Art

In a recording device represented by a facsimile, a printer, or the like, there is a device provided with a sheet discharge tray that receives a recording sheet recorded and discharged, and a configuration in which the sheet discharge tray is provided with a plurality of trays, and a sheet discharge receiving surface is extended by pulling out each of the trays. JP-A-2009-046271 describes an example of such a configuration.

For example, when the sheet discharge tray is provided with a first tray and a second tray configured to protrude from the device main body further than the first tray, and the second tray completely protrudes from the device main body, the second tray needs to be supported by the first tray.

In this case, it is preferable that a rail supporting the first tray in the device main body extends to a front surface of the device as far as possible from the viewpoint of stably supporting the first tray. However, when the rail supporting the first tray is extended to the front surface of the device, it may be necessary to form a escape shape in the first tray or the second tray so that the first tray or the second tray does not interfere with the rail when each tray is accommodated in the device main body. In that case, the structure of the first tray or the second tray may be complicated, resulting in an increase in cost.

SUMMARY

According to an aspect to the present disclosure, there is provided a recording device including a medium receiving tray configured to switch between a first state in which the medium receiving tray is accommodated in the device main body and a second state in which the medium receiving tray most protrudes from the device main body, and that receives the medium discharged toward an outside of the device main body in the second state or a state of protruding from the device main body toward the second state from the first state, in which the medium receiving tray is configured to include a first tray configured to be displaced with respect to a rail provided in the device main body, and a second tray configured to be displaced with respect to the first tray, the second tray further protruding from the device main body than the first tray in the second state and being supported by the first tray, the device main body includes at least one support member configured to be at an advanced position at which the support member advances with respect to a side surface of the medium receiving tray and a retracted position at which the support member retracts from the advanced position, the support member is at a position protruding from an end portion of the rail in a protruding direction of the first tray from the device main body, the support member is at the retracted position when the medium receiving tray is in the first state, and the support member is at the advanced position and supports the first tray from below when the medium receiving tray is in the second state.

DESCRIPTION OF EXEMPLARY EMBODIMENTS

Figure 1:
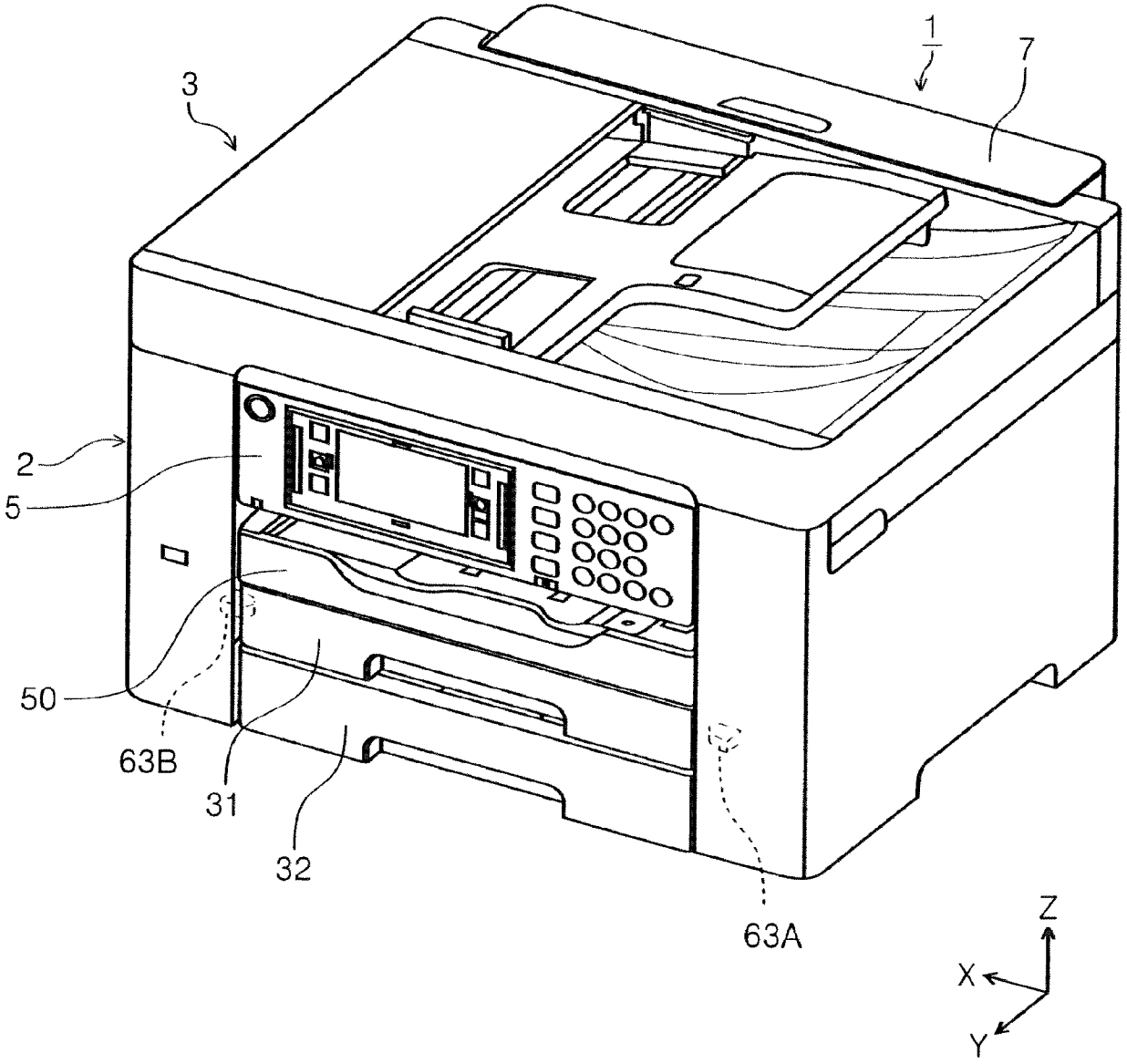
FIG. 1 is a perspective view of a printer in a state where a discharge tray is accommodated.

Hereinafter, the present disclosure will be schematically described.

A recording device according to the first aspect includes a device main body that includes a recording unit which records on a medium, and a medium receiving tray configured to switch between a first state in which the medium receiving tray is accommodated in the device main body and a second state in which the medium receiving tray most protrudes from the device main body, and that receives the medium discharged toward an outside of the device main body in the second state or a state of protruding from the device main body toward the second state from the first state, in which the medium receiving tray is configured to include a first tray configured to be displaced with respect to a rail provided in the device main body, and a second tray configured to be displaced with respect to the first tray, the second tray further protruding from the device main body than the first tray in the second state and being supported by the first tray, the device main body includes at least one support member configured to be at an advanced position at which the support member advances with respect to a side surface of the medium receiving tray and a retracted position at which the support member retracts from the advanced position, the support member is at a position protruding from an end portion of the rail in a protruding direction of the first tray from the device main body, the support member is at the retracted position when the medium receiving tray is in the first state, and the support member is at the advanced position and supports the first tray from below when the medium receiving tray is in the second state.

In this configuration, there is provided at least one support member configured to be at the advanced position that advances with respect to the medium receiving tray and the retracted position that retracts from the advanced position. The support member is at the retracted position when the medium receiving tray is in the first state, and the support member is at the advanced position and supports the first tray from below when the medium receiving tray is in the second state. Therefore, the medium receiving tray in the second state can be stably supported.

In addition, since the length which extends the rail in the protruding direction can be suppressed, it is not necessary to form a escape shape in the first tray or the second tray, and increase in cost accompanying the complexity of a structure can be suppressed.

In a second aspect according to the first aspect, the second tray is positioned below the first tray, the support member is pressed toward a side surface of the second tray by a pressing member, the support member is at the retracted position and presses against the side surface of the second tray, when the medium receiving tray is in the first state, the second tray is pulled out from a region facing the support member, and the support member is switched from the retracted position to the advanced position, when the medium receiving tray is switched from the first state to the second state, and the support member is switched from the advanced position to the retracted position by the second tray pushing the support member against a pressing force of the pressing member, when the medium receiving tray is switched from the second state to the first state.

In this configuration, the support member is engaged with the second tray and switches between the advanced position and the retracted position in accordance with the displacement operation of the second tray. Therefore, the configuration which displaces the support member can be configured at low cost.

In addition, since the support member presses against the side surface of the second tray when the medium receiving tray is in the first state, it is possible to suppress rattling of the medium receiving tray in the first state.

In a third aspect according to the second aspect, a surface of the support member pressed by the second tray when the medium receiving tray is switched from the second state to the first state is formed by a surface intersecting a displacement direction of the second tray.

In this configuration, in the support member, a surface pressed by the second tray when the medium receiving tray is switched from the second state to the first state is formed by a surface intersecting a displacement direction of the second tray. Therefore, the possibility that the second tray is caught by the support member can be suppressed.

In a fourth aspect according to any one of the first to third aspects, the support member is provided on each side of the second tray.

In this configuration, since the support members are provided on both sides of the second tray, the first tray can be supported more stably.

In a fifth aspect according to the second or third aspect, the recording device further includes a drive unit configured to displace the medium receiving tray and provided at a position facing one side surface of the medium receiving tray in the device main body, in which the drive unit includes two pinion gears, the first tray includes a first rack portion that meshes with one pinion gear of the two pinion gears, the second tray includes a second rack portion that meshes with an other pinion gear of the two pinion gears, and the first tray and the second tray are displaced by a rotation of the two pinion gears.

In this configuration, since the first tray and the second tray are configured to be displaced by the drive unit, convenience for the user is improved.

In a sixth aspect according to the fifth aspect, the support member includes a first support member on a side on which the drive unit is provided of both sides of the second tray, and a second support member on a side opposite from a side on which the first support member is provided, and the second support member presses the second tray with a pressing force stronger than a pressing force of the first support member, when the medium receiving tray is in the first state.

In this configuration, the support member includes the first support member on the side where the drive unit is provided of both sides of the second tray, and the second support member on a side opposite to the side on which the first support member is provided, that is, the support member is provided on both sides of the second tray. Therefore, the first tray can be supported more reliably and appropriately.

When the medium receiving tray is in the first state, the second support member on the side opposite to the side on which the drive unit is provided presses the second tray with a stronger pressing force than that of the first support member on the side on which the drive unit is provided, that is, the second tray is pressed toward the drive unit. Therefore, the meshing between the pinion gear and the second rack portion provided on the second tray can be appropriately maintained.

In a seventh aspect according to any one of the first to sixth aspects, the medium receiving tray is configured to be pulled out from the device main body, the recording device further includes a restriction unit configured to switch between a permission state in which the medium receiving tray is permitted to be pulled out from the device main body and a restriction state in which the pulling out from the device main body is restricted.

In this configuration, since the medium receiving tray is configured to be pulled out from the device main body, the inside of the device main body can be easily accessed by pulling out the medium receiving tray from the device main body. In addition, there is provided the restriction unit that can switch between a state of permitting the medium receiving tray to be pulled out from the device main body and a state of regulating to be pulled out from the device main body. Therefore, it is possible to prevent the medium receiving tray from being pulled out carelessly.

In an eighth aspect according to the seventh aspect, the restriction unit includes a restriction portion provided on the device main body, a restricted portion provided on the first tray and configured to switch between a state in which the restricted portion is configured to be engaged with the restriction portion and a state in which the restriction portion is not configured to be engaged with the restriction portion, and an operation portion, provided on the first tray, for switching the state of the restricted portion.

In this configuration, the restriction unit can be obtained with a simple configuration.

In a ninth aspect according to the seventh or eighth aspect, the recording device further includes a first medium transport path which is a medium transport path facing the recording unit, and configured to transport the medium in a first direction which is a medium transport direction when recording on the medium is performed and in a second direction opposite from the first direction, a reverse path on which a surface of the medium is reversed, a second medium transport path that guides the medium recorded by the recording unit to the reverse path, a third medium transport path that is positioned below the second medium transport path, guides the medium on which recording is performed by the recording unit to the reverse path, and is different from the second medium transport path, a path forming portion that forms a portion of a lower side of the third medium transport path, and is positioned above the medium receiving tray mounted on the device main body, and a medium storage cassette positioned below the medium receiving tray and configured to accommodate the medium and be detached from the device main body, in which the path forming portion is configured to be displaced downward in a state where the medium receiving tray and the medium storage cassette are removed from the device main body, and a portion of the third medium transport path is exposed when the supporting member is displaced downward.

In this configuration, the path forming portion can be displaced downward in a state where the medium receiving tray and the medium storage cassette are removed from the device main body, and a portion of the third medium transport path is exposed when the supporting member is displaced downward. Therefore, when a jam occurs in the third medium transport path, jam processing can be easily performed.

In a tenth aspect according to the ninth aspect, the path forming portion is provided with an abutting portion on which the medium receiving tray abuts in a state where the path forming portion is displaced downward, and the medium receiving tray abuts on the abutting portion in a state where the path forming portion is displaced downward, so that the restriction unit is prevented from being switched to the restriction state.

In this configuration, the abutting portion provided on the medium receiving tray prevents the restriction unit from switching to the restriction state when the path forming portion is displaced downward. Therefore, it is possible to prevent the medium receiving tray from being mounted in an inappropriate state, that is, in a state where the path forming portion is displaced downward, and to prevent damage or the like caused by forcibly mounting the medium receiving tray in the inappropriate state.

Hereinafter, the present disclosure will be described in detail.

In each drawing, a direction along an X axis is a device width direction and a direction intersecting a sheet transport direction, that is, a sheet width direction. The −X direction is a right direction when viewed from a user in a case in which a front surface of the device faces the user, and the +X direction is a left direction, similarly.

In addition, a direction along a Y axis is a device depth direction, and the +Y direction is a direction from a rear surface to the front surface of the device, and a first direction. In addition, the −Y direction is a direction from the front surface to the rear surface of the device and is a second direction.

In addition, a direction along a Z axis is a vertical direction, the +Z direction is vertically upward, and the −Z direction is vertically downward.

In the present embodiment, a side surface provided with an operation portion 5 among the side surfaces constituting a periphery of the device is the front surface of the device.

In FIG. 1, an ink jet printer 1 which is an example of a recording device is a so-called multifunctional peripheral provided with a scanner portion 3 on an upper portion of a device main body 2. Hereinafter, the ink jet printer 1 is abbreviated as a printer 1.

The device main body 2 has a function of recording on a recording sheet as an example of a medium, and the scanner portion 3 has a function of reading a document. The scanner portion 3 is provided with an automatic document feeder (ADF) that automatically feeds a set document.

The device main body 2 is provided with a transport path (described later) for transporting the recording sheet and a recording head 9 (refer to FIG. 2) as an example of a recording unit. In addition, in the present embodiment, two medium storage cassettes, specifically, a first sheet cassette 31 and a second sheet cassette 32 are detachably provided.

In addition, the device main body 2 is configured to be able to set and feed the sheet from the rear surface of the device in addition to setting the sheet to the first sheet cassette 31 and the second sheet cassette 32. Reference numeral 7 denotes a cover for opening and closing a sheet setting port (not illustrated) when setting the sheet from the rear surface of the device.

The device main body 2 is provided with the operation portion 5 that performs various operations of the printer 1 on the front surface of the device. The operation portion 5 is provided with a display portion and a plurality of operation buttons and is provided to be tiltable.

A discharge tray 50 serving as a medium receiving tray that receives the recording sheet recorded and discharged is provided on a lower side of the operation portion 5. As illustrated in FIG. 1, the discharge tray 50 is provided so as to be able to be in a state of being accommodated inside the device main body 2 and a state of being pulled out from the device main body 2 (refer to FIGS. 3 and 4).

In addition, the discharge tray 50 can be pulled out from the device main body 2.

The discharge tray 50 will be described in detail later.

Figure 2:
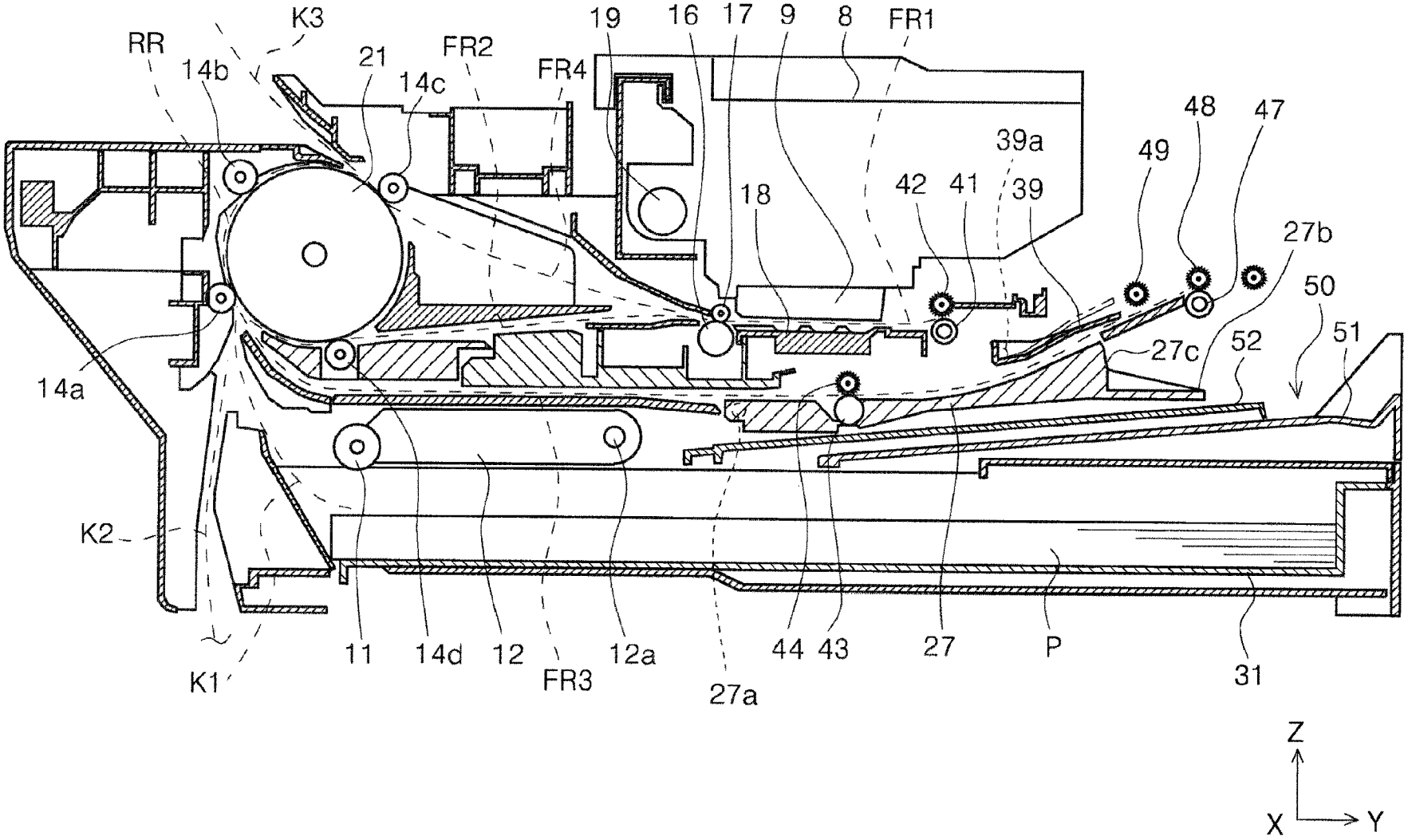
FIG. 2 is a side sectional view illustrating a sheet transport path of the printer.

Subsequently, the transport path of the recording sheet will be described with reference to FIG. 2. In FIG. 2, the illustration of the second sheet cassette 32 is omitted.

In the printer 1, the recording sheet is transported to a transport drive roller 16 through a reverse roller 21 constituting a reverse path RR regardless of a feeding path, and is transported to a recording region by the recording head 9 by the transport drive roller 16.

More specifically, as a sheet feeding path, the printer 1 is provided with a sheet feeding path K1 for feeding the recording sheet from the first sheet cassette 31, a sheet feeding path K2 for feeding the recording sheet from the second sheet cassette 32 below the first sheet cassette 31, and a sheet feeding path K3 for manually feeding the recording sheet from the upper rear of the device.

In addition, as sheet transport paths, the printer 1 is provided with a first sheet transport path FR1 that is a sheet transport path facing the recording head 9 and that can transport the recording sheet in the first direction (+Y direction), which is the sheet transport direction when recording on the recording sheet, and the second direction (−Y direction) opposite thereto, the reverse path RR for reversing the surface of the recording sheet, a second sheet transport path FR2 for guiding the recording sheet on which recording is performed to the reverse path RR, and a third sheet transport path FR3 positioned vertically below the second sheet transport path FR2, guides the recorded recording sheet to the reverse path RR, and different from the second sheet transport path FR2.

In the present embodiment, the first sheet transport path FR1 is a sheet transport path between the transport drive roller 16 and a first discharge drive roller 41. In addition, the second sheet transport path FR2 is a sheet transport path between the transport drive roller 16 and a driven roller 14*a* through a driven roller 14*d*. In addition, the third sheet transport path FR3 is a sheet transport path between a second discharge drive roller 47 and the driven roller 14*a* through a reverse drive roller 43. In addition, the reverse path RR is a sheet transport path between the driven roller 14*a* and a driven roller 14*c*. In FIG. 2, reference numeral FR4 is a sheet transport path (fourth sheet transport path) between the driven roller 14*c* and the transport drive roller 16.

The recording sheet is fed by a feeding roller 11 in the sheet feeding path K1. The feeding roller 11 is supported by a support member 12 that swings around a swing shaft 12*a*, and the feeding roller 11 advances and retreats with respect to a recording sheet P accommodated in the first sheet cassette 31 by the swing of the support member 12.

The second sheet cassette 32 (not illustrated in FIG. 2) provided under the first sheet cassette 31 is also provided with a similar feeding mechanism (not illustrated).

The reverse roller 21 is formed to have a largest diameter as compared with other rollers, and reverses the recording sheet in a curved manner. Driven rollers 14*a*, 14*b*, 14*c*, and 14*d* are provided around the reverse roller 21. The recording sheet fed through the sheet feeding paths K1 and K2 is sent to the transport drive roller 16 through the reverse path RR and the fourth sheet transport path FR4.

The recording sheet fed through the sheet feeding path K3 is sent to the transport drive roller 16 through the fourth sheet transport path FR4.

The recording sheet sent along the −Y direction through the second sheet transport path FR2 is sent to the transport drive roller 16 through the reverse path RR and the fourth sheet transport path FR4.

Similarly, the recording sheet sent along the −Y direction through the third sheet transport path FR3 is sent to the transport drive roller 16 through the reverse path RR and the fourth sheet transport path FR4.

The recording sheet sent to the transport drive roller 16 driven by a drive source (not illustrated) is nipped by the transport drive roller 16 and a transport driven roller 17 driven to rotate, is sent to a region facing the recording head 9, that is, a recording region, and recording is performed.

A carriage 8 provided with the recording head 9 is reciprocated in the X axis direction by a power source (not illustrated) while being guided by a carriage guide shaft 19 extending in the X axis direction. The recording head 9 ejects an ink onto the recording sheet as the carriage 8 moves.

A support member 18 is provided at a position facing the recording head 9, and the recording sheet on which recording is performed by the recording head 9 is supported by the support member 18.

At downstream of the support member 18, the first discharge drive roller 41 rotationally driven, and a first discharge driven roller 42 driven to rotate which send the recording sheet on which recording is performed downstream are provided. The first discharge drive roller 41 and the first discharge driven roller 42 driven to rotate are a pair of rollers that are first positioned downstream of the recording head 9.

Furthermore, at downstream thereof, the second discharge drive roller 47 rotationally driven and a second discharge driven roller 48 driven to rotate are provided.

In the printer 1 provided with the sheet path described above, the feeding roller 11 and the reverse roller 21 are driven by a first motor (not illustrated), the transport drive roller 16 and the first discharge drive roller 41 are driven by a second motors (not illustrated), and the second discharge drive roller 47 and the reverse drive roller 43 are driven by a third motor (not illustrated).

Although described later in detail, the discharge tray 50 is driven using a fourth motor (not illustrated) as a drive source.

Hereinafter, the second sheet transport path FR2, the third sheet transport path FR3, and the reverse path RR will be further described.

When recording is performed on a second surface, opposite to a first surface, of the recording sheet on which the recording is performed on the first surface, the recording sheet on which the recording is performed is sent to the reverse path RR. As the sheet transport path at that time, either the second sheet transport path FR2 or the third sheet transport path FR3 can be selected.

A path length of the third sheet transport path FR3 is longer than a path length of the second sheet transport path FR2. Therefore, the control unit (not illustrated) of the printer 1 has a sheet length threshold, and when the length of the recording sheet exceeds the threshold, the third sheet transport path FR3 is selected, and when the length of the recording sheet is equal to or less than the threshold, the second sheet transport path FR2 is selected.

When the second sheet transport path FR2 is used, after the recording on the first surface is completed, the transport drive roller 16, the first discharge drive roller 41, and the second discharge drive roller 47 are reversed. As a result, the recording sheet is transported along the −Y direction on the second sheet transport path FR2 and reaches the reverse path RR.

When the third sheet transport path FR3 is used, after the recording on the first surface is completed, the sheet is transported along the +Y direction until a trailing edge of the sheet reaches a driven roller 49 provided near the upstream of the second discharge drive roller 47. Thereafter, the second discharge drive roller 47 is reversed. A flap 39 that can swing around a swing shaft 39*a* is provided upstream of the driven roller 49, and when the recording sheet is sent to the third sheet transport path FR3, raises an end portion of the flap 39 in the +Y direction upward. As a result, the recording sheet is sent to the third sheet transport path FR3 and sent to the reverse path RR.

In the present embodiment, the +Y direction region of the third sheet transport path FR3 can be exposed, and the third sheet transport path FR3 can be accessed from the front of the device, and the printer 1 is configured to be removable a jammed recording sheet when a jam occurs in the third sheet transport path FR3.

Figure 14:
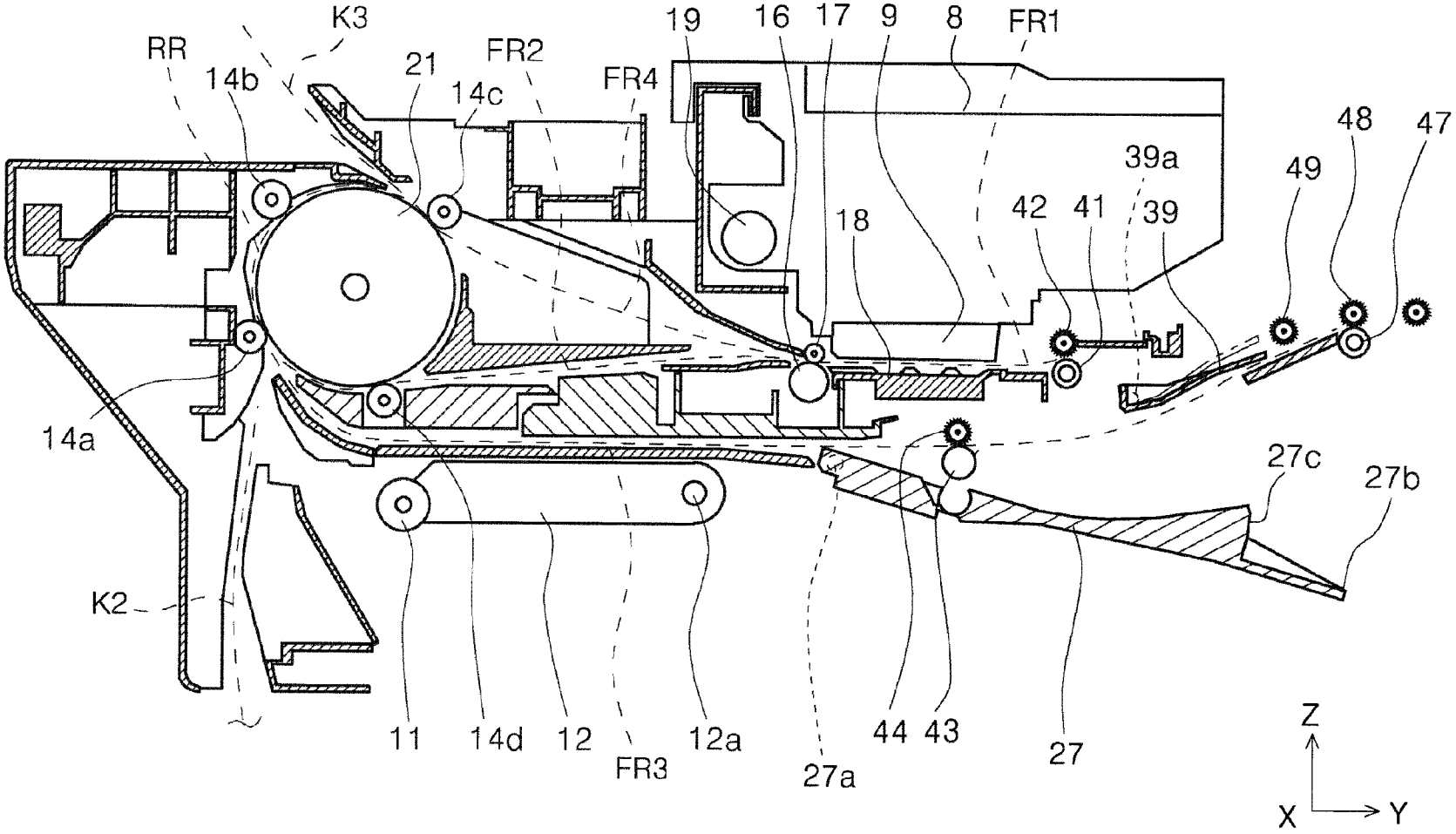
FIG. 14 is a side sectional view illustrating the sheet transport path of the printer.
Figure 15:
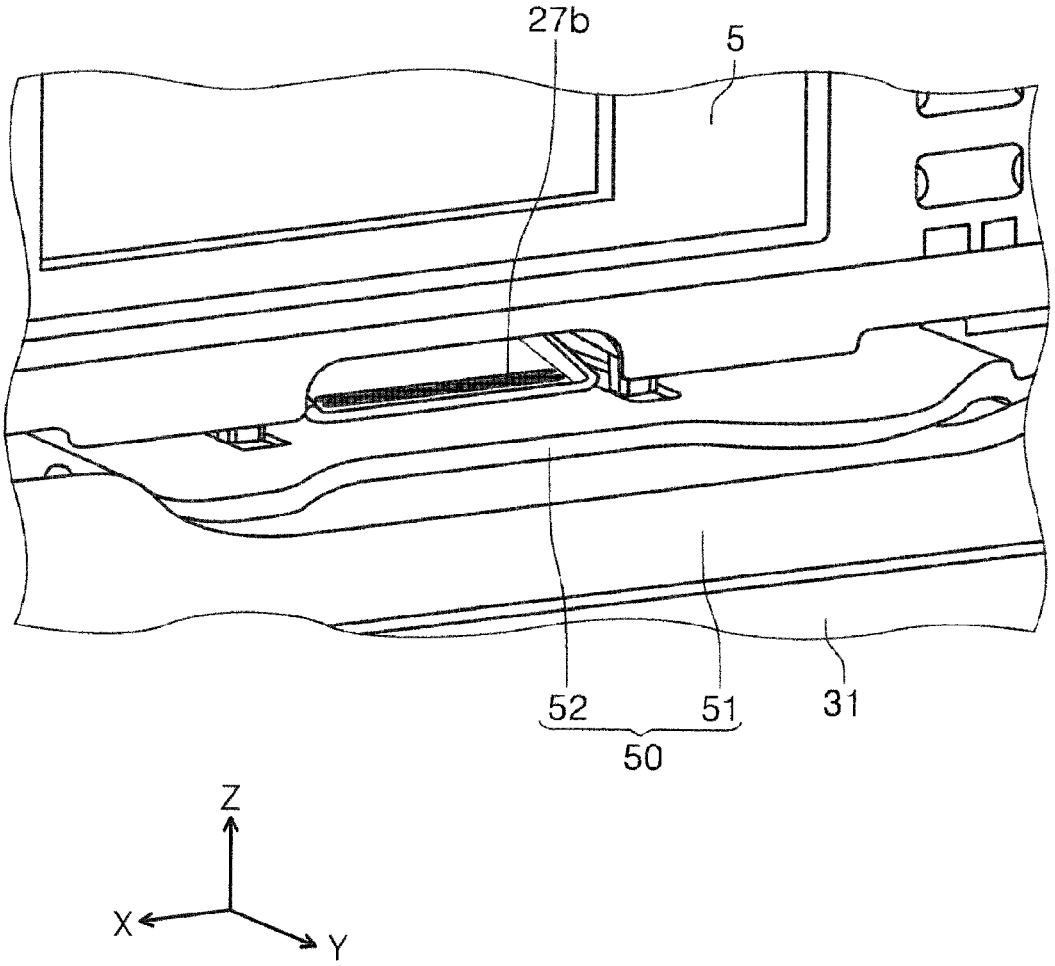
FIG. 15 is a partially enlarged perspective view of a front surface of the printer.

More specifically, a path forming portion 27 that forms a portion of the lower side of the third sheet transport path FR3 is provided above the first sheet cassette 31. The path forming portion 27 is provided so as to be swingable by pushing down an end portion 27*b* in the +Y direction with a swing shaft 27*a* as the swing center. Although the end portion 27*b* cannot be pushed down when the discharge tray 50 and the first sheet cassette 31 are mounted as illustrated in FIG. 15, the end portion 27*b* can be pushed down by removing the discharge tray 50 and the first sheet cassette 31 from the device main body 2, and the path forming portion 27 can be displaced downward as illustrated in FIG. 14. As a result, when the +Y direction region of the third sheet transport path FR3 is exposed and the recording sheet is jammed in the third sheet transport path FR3, the jammed recording sheet can be removed.

Although the second discharge drive roller 47 and the reverse drive roller 43 obtain power from the third motor (not illustrated) that is a common drive source, a rotation regulation mechanism (not illustrated) is provided in the power transmission path from the third motor to the reverse drive roller 43, and the reverse drive roller 43 rotates in the direction of transporting the recording sheet in the −Y direction (counterclockwise direction in FIG. 2) regardless of the rotation direction of the third motor by the rotation regulation mechanism. The rotation regulation mechanism can be configured to include a mechanism including a one-way clutch or a mechanism including a planetary gear mechanism, for example.

On the other hand, the second discharge drive roller 47 rotates normally when the third motor rotates normally, and reverses when the third motor rotates reversely.

Subsequently, the discharge tray 50 will be described in detail.

The discharge tray 50 as a medium receiving tray can be switched between a first state (refer to FIG. 1) accommodated in the device main body 2 and a second state (refer to FIG. 4) that protrudes most from the device main body 2. In the second state or in a state protruding from the device main body 2 from the first state to the second state, the recording sheet discharged toward the outside of the device main body 2 is received.

The discharge tray 50 is provided with a first tray 52 displaceable with respect to a rail 60*a* (refer to FIG. 5) provided in the device main body 2, and a second tray 51 displaceable with respect to the first tray 52, protrudes from the device main body 2 than the first tray 52 in the second state, and is supported by the first tray 52.

Figure 5:
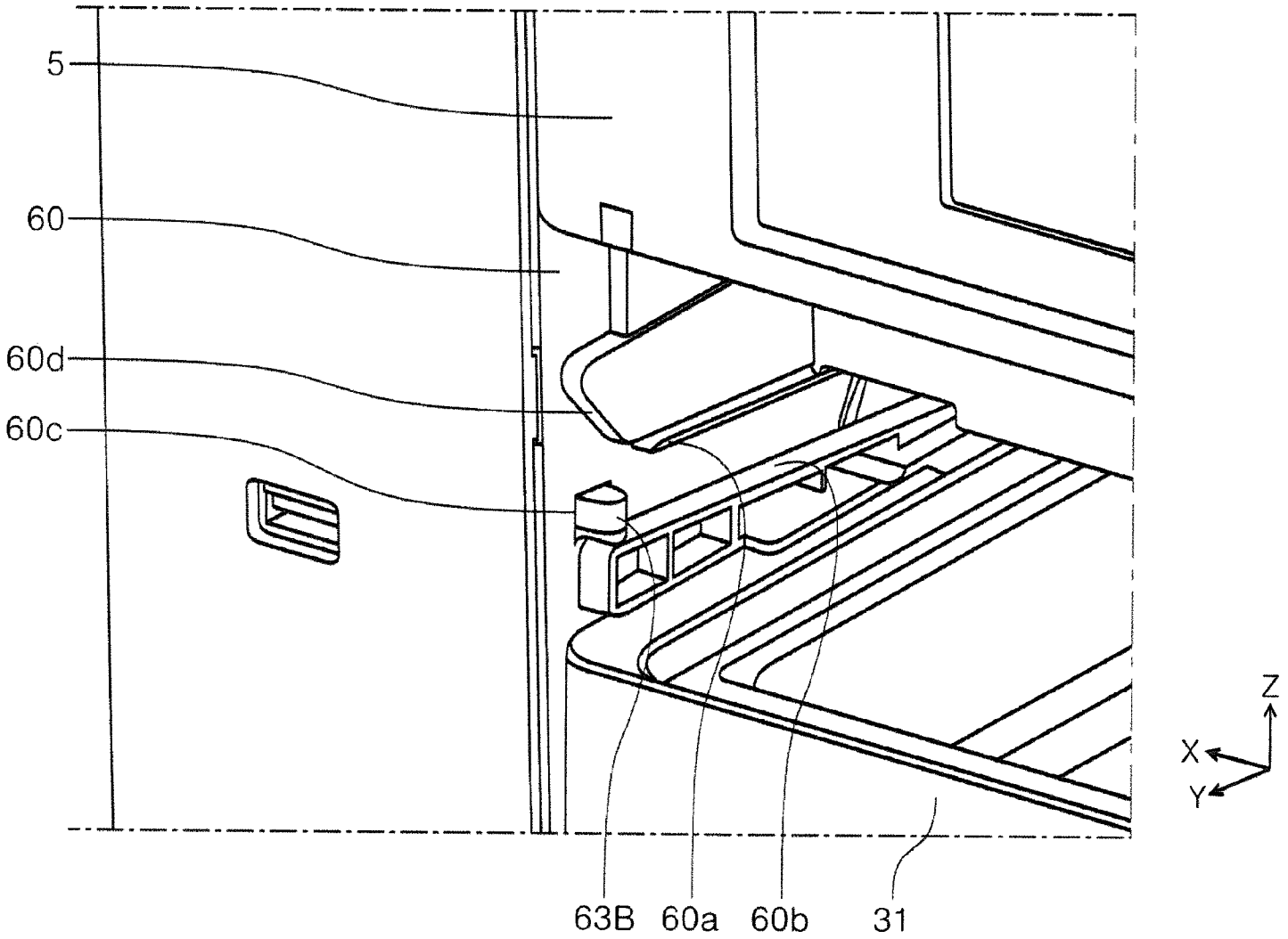
FIG. 5 is a perspective view of a rail and a support member.

FIG. 5 illustrates a configuration of the left side surface of the storage region of the discharge tray 50, the same configuration is also provided on the right side surface in a bilaterally symmetric structure.

Figure 6:
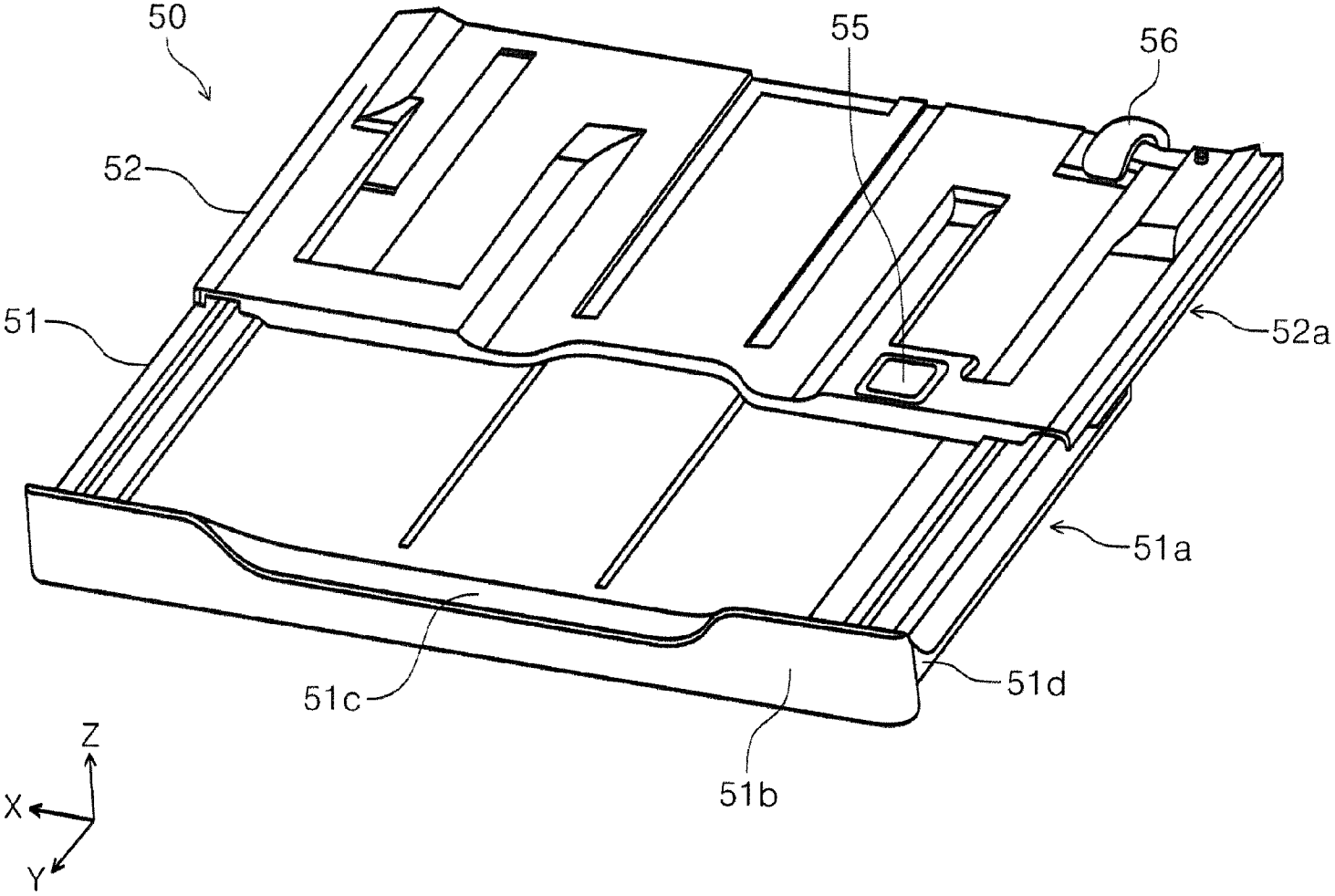
FIG. 6 is a perspective view of the discharge tray.

As illustrated in FIG. 6, the second tray 51 is provided on a lower side of the first tray 52. The second tray 51 has a front wall 51*b* at the end portion in the +Y direction, that is, a protruding direction of each tray from the device main body 2, and the front wall 51*b* functions as a stopper that suppresses jumping-out of the recording sheet to be discharged. The front wall 51*b* is provided with a recessed portion 51*c* for hooking fingers.

In a state where the discharge tray 50 is in the first state, that is, the storage state, and the operation portion 5 is completely closed, as illustrated in FIG. 1, the front surfaces of the front wall 51*b*, the first sheet cassette 31, the second sheet cassette 32, the operation portion 5, the device main body 2, and the scanner portion 3 are flush with each other.

Figure 7:
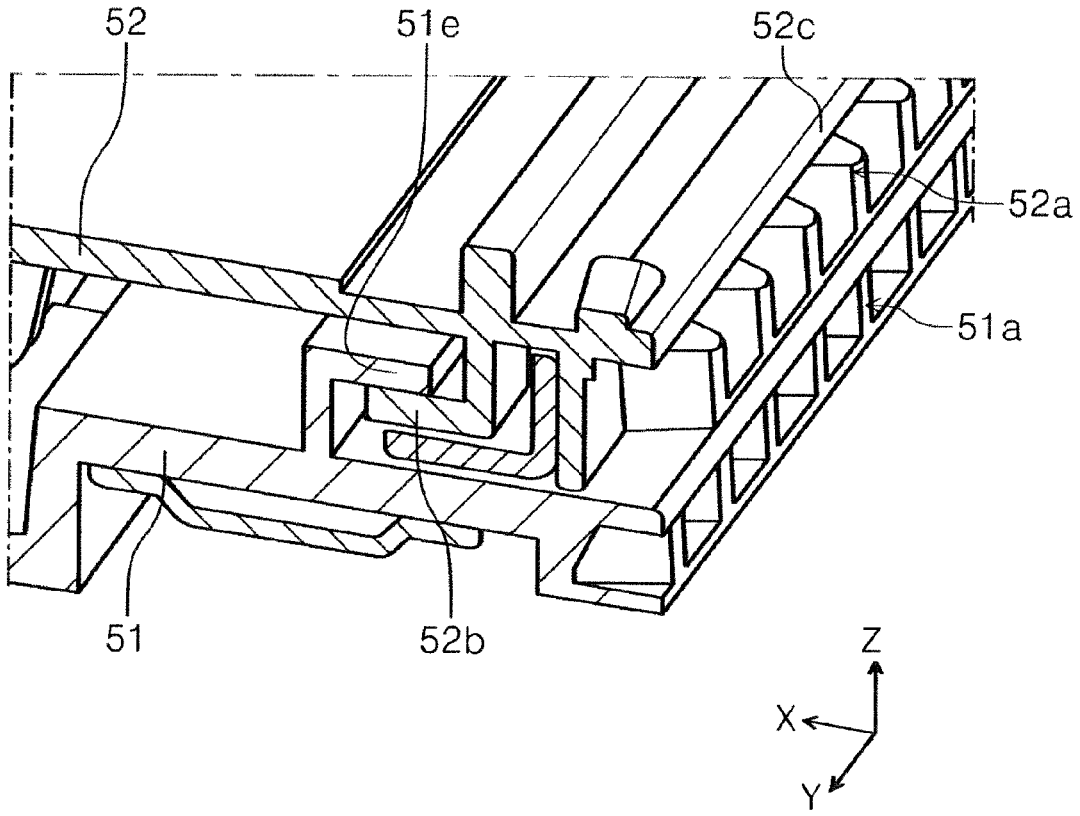
FIG. 7 is a partial sectional view of the discharge tray.

As illustrated in FIG. 7, a support portion 52*b* is formed on the lower surface of the first tray 52 so as to extend in the Y axis direction, and a supported portion 51*e* is formed on the upper surface of the second tray 51 so as to extend in the Y axis direction. The second tray 51 is supported by the first tray 52 by placing the supported portion 51*e* on the support portion 52*b* from above. FIG. 7 illustrates a structure of the end portions of the first tray 52 and the second tray 51 in the −X direction, the same configuration is also provided on the end portion in the +X direction in a bilaterally symmetric structure.

A first rack portion 52*a* is formed on the side surface of the first tray 52 in the −X direction along the Y axis direction, and a second rack portion 51*a* is formed on the side surface of the second tray 51 in the −X direction along the Y axis direction. These rack portions will be described later.

Figure 11:
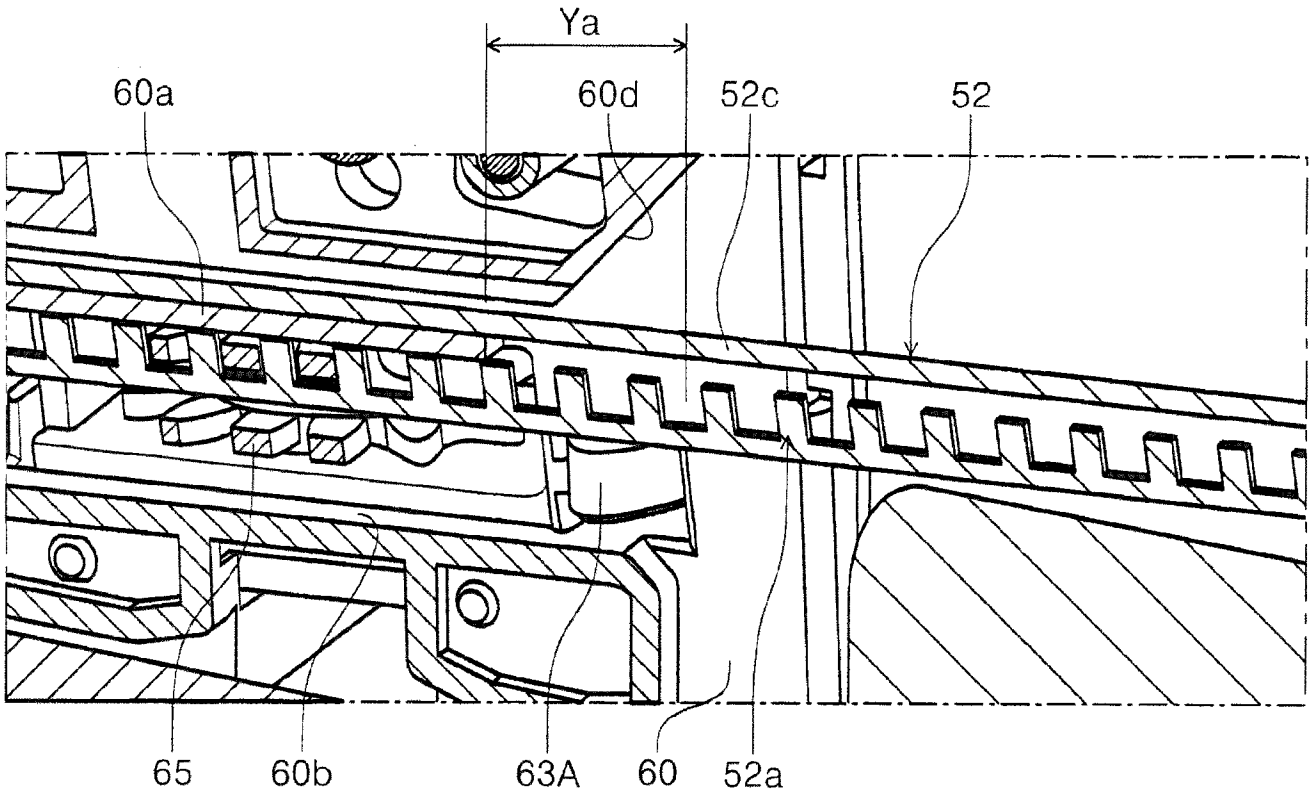
FIG. 11 is a sectional perspective view of the discharge tray and the rail.

On the side surface in the −X direction and the side surface in the +X direction of the first tray 52, supported portions 52*c* are formed along the Y axis direction. FIG. 7 illustrates the supported portion 52*c* formed on the side surface of the first tray 52 in the −X direction. As illustrated in FIG. 11, the rail 60*a* provided in the device main body 2 enters the lower side of the supported portion 52*c*, so that the first tray 52 is supported by the rail 60*a*. The supported portion 52*c* illustrated in FIG. 7 is supported by the rail 60*a* (refer to FIG. 11) provided on the right side of the device main body 2. The rail 60*a* illustrated in FIG. 5 supports a supported portion 52*c* provided on the side surface of the first tray 52 in the +X direction.

As illustrated in FIGS. 5 and 11, a guide slope 60*d* is provided on a frame 60 that forms the storage region of the discharge tray 50 in the device main body 2. When the discharge tray 50 removed from the device main body 2 is mounted on the device main body 2, the guide slope 60*d* guides the end portion of the discharge tray 50 in the −Y direction to a correct mounting position.

That is, the above-described supported portion 52*c* is guided on the rail 60*a* by the guide slope 60*d*.

As illustrated in FIG. 6, the first tray 52 is provided with an operation portion 55 and a hook 56. In a state where the discharge tray 50 is attached to the device main body 2, since the hook 56 is engaged with a restriction portion 57 (refer to FIG. 13), the discharge tray 50 is in a state of being held so as not to drop off from the device main body 2. In other words, the discharge tray 50 is restricted so as not to be pulled out from the device main body 2.

Figure 13:
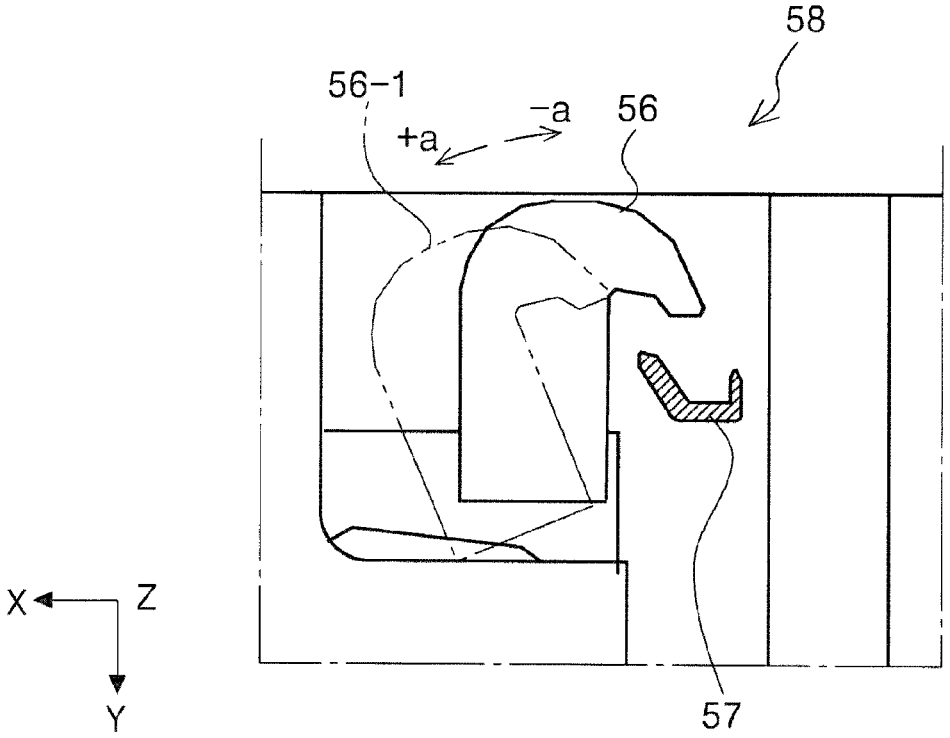
FIG. 13 is a plan view illustrating a discharge tray locking mechanism.

More specifically, as illustrated in FIG. 13, a restriction unit 58 is provided, and the restriction unit 58 is provided with the hook 56 as a restricted portion, the restriction portion 57, and the operation portion 55 (refer to FIG. 6). The hook 56 can swing in the +a direction and the −a direction in FIG. 13 around the swing shaft (not illustrated), and is pressed by an elastic portion (not illustrated) toward a direction indicated by the solid line in FIG. 13, that is, the state where the hook 56 can engage with the restriction portion 57 (−a direction). In this state, since the hook 56 is in a restriction state where the hook 56 can be engaged with the restriction portion 57, the pulling out of the discharge tray 50 in the +Y direction is restricted.

Figure 3:
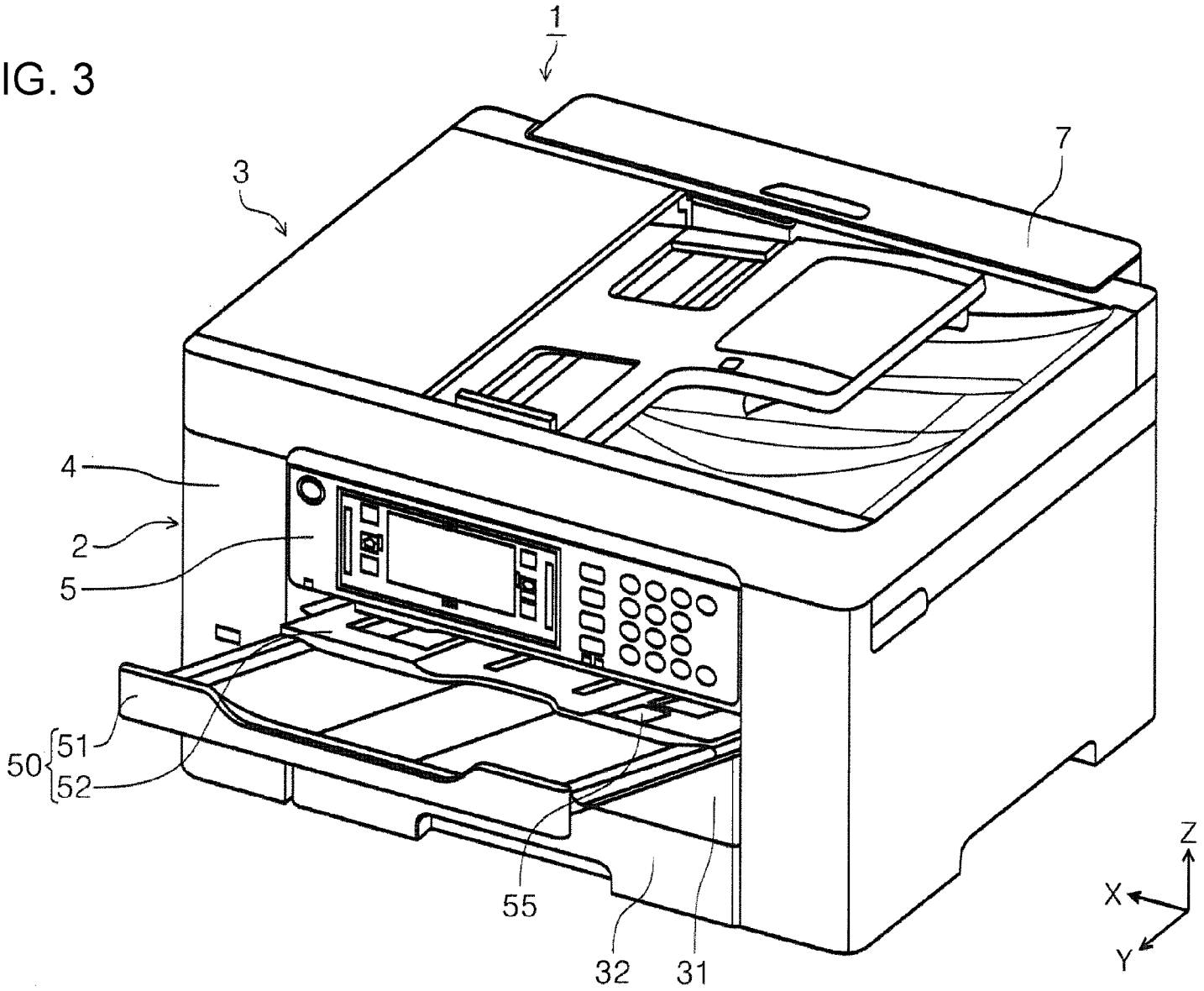
FIG. 3 is a perspective view of the printer in a state where the discharge tray is pulled out halfway.

When the operation portion 55 (refer to FIG. 6) is slid in the +Y direction from this state, the hook 56 swings in the +a direction in FIG. 3 due to the action of a link mechanism (not illustrated), and is in a state of not being able to be engaged with the restriction portion 57 as indicated by a two-dot chain line and reference numeral 56-1. Therefore, a permission state where the discharge tray 50 is permitted to be pulled out from the device main body 2 is obtained.

By operating the operation portion 55 (refer to FIG. 6) as described above, the hook 56 moves, the state where the pulling out of the discharge tray 50 is restricted is eliminated, and the discharge tray 50 can be detached from the device main body 2.

As described above, by removing the discharge tray 50 and the first sheet cassette 31 from the device main body 2, the path forming portion 27 can be displaced downward as described with reference to FIG. 14, and the third sheet transport path FR3 can be exposed.

Figure 16:
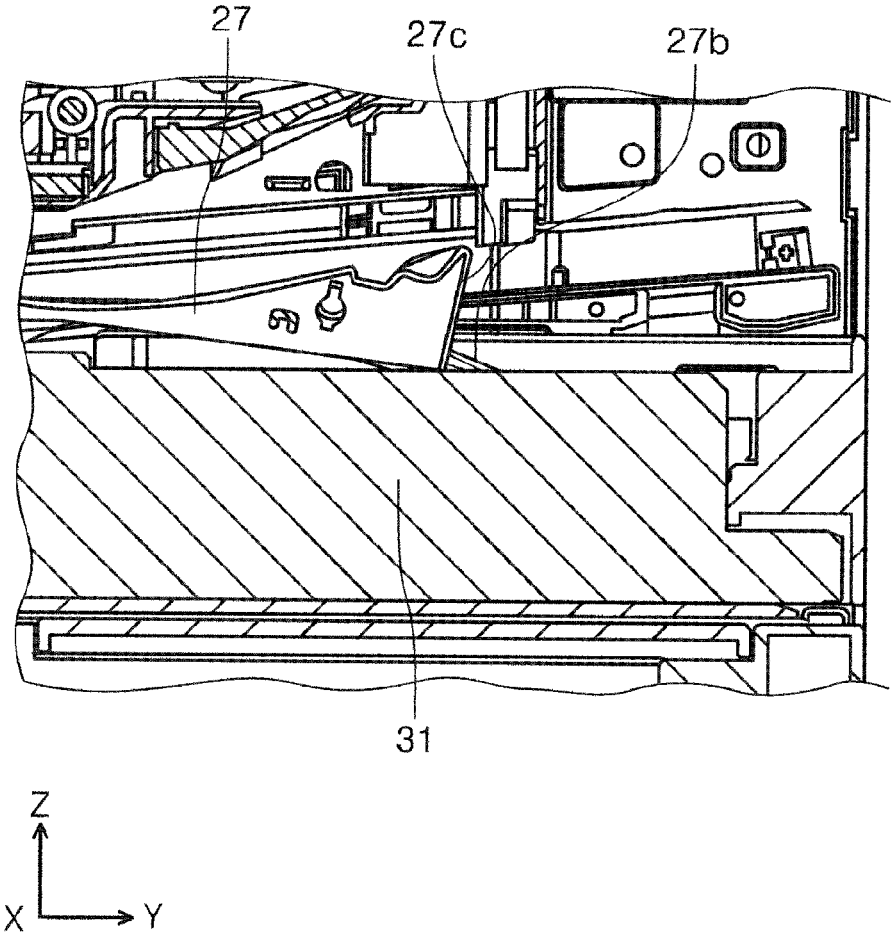
FIG. 16 is a sectional view cut at a position of a side wall of a first sheet cassette.
Figure 17:
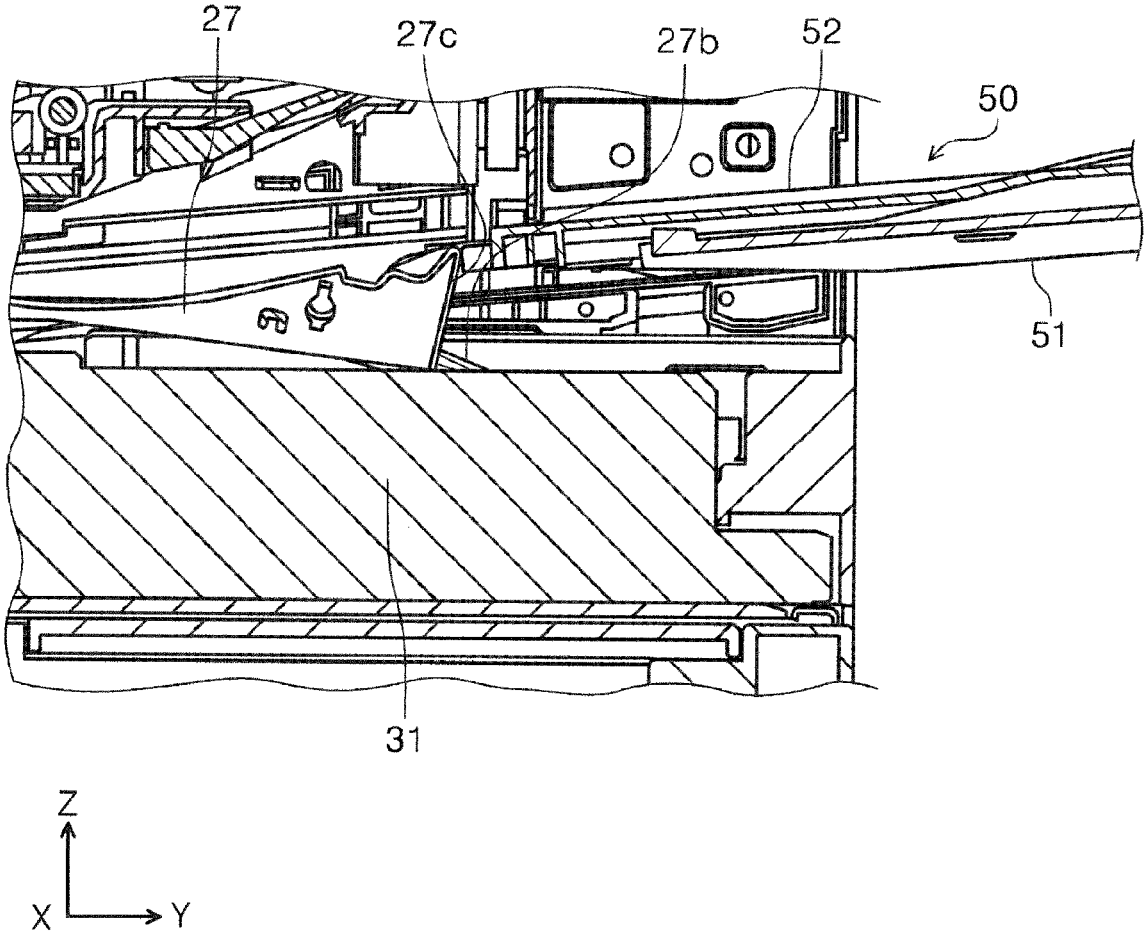
FIG. 17 is a sectional view cut at the position of the side wall of the first sheet cassette.

As illustrated in FIG. 16, the path forming portion 27 is provided with an abutting portion 27*c*, and in a state where the path forming portion 27 is displaced downward, as illustrated in FIG. 17, a tip end of the first tray 52 constituting the discharge tray 50 abuts on the abutting portion 27*c*, and the mounting of the first tray 52 is hindered. As a result, the restriction unit 58 is prevented from switching to the restriction state. With such a configuration, it is possible to prevent the discharge tray 50 from being mounted in an inappropriate state, that is, in a state where the path forming portion 27 is displaced downward, and to prevent damage or the like caused by forcibly mounting the discharge tray 50 in the inappropriate state.

Subsequently, as illustrated in FIG. 5, a support surface 60*b* is provided below the rail 60*a*. The support surface 60*b* supports the second tray 51 when the second tray 51 is accommodated in the device main body 2. That is, the second tray 51 is supported by the support surface 60*b* until protruding from the device main body 2, and after protruding from the device main body 2, the second tray 51 is supported by the support portion 52*b* (refer to FIG. 7) of the first tray 52 as described above.

In the present embodiment, the rail 60*a* and the support surface 60*b* have a predetermined angle with respect to the horizontal plane, and are formed to be inclined upward in the +Y direction. As a result, the discharge tray 50 protruding from the device main body 2 is inclined upward in the +Y direction.

The support member is provided in the protruding direction of the first tray 52, that is, in the +Y direction with respect to the end portion of the rail 60*a* in the +Y direction. The support member is provided at a position facing the left side surface of the second tray 51 and a position facing the right side surface of the second tray 51 in the device main body 2. In FIGS. 1 and 5, the support member provided at a position facing the left side surface of the second tray 51 is indicated by reference numeral 63B. In FIGS. 1 and 8 to 11, the support member provided at a position facing the right side surface of the second tray 51 is indicated by reference numeral 63A. That is, in the present embodiment, the support member includes a first support member 63A and a second support member 63B. Hereinafter, when it is not necessary to distinguish the first support member 63A and the second support member 63B, these are simply referred to as a support member 63.

As illustrated in FIG. 5, the support member 63 is provided so as to be able to protrude from an opening portion 60*c* formed in the frame 60 toward the second tray 51, that is, provided so as to be able to advance and retreat with respect to the second tray 51. FIGS. 5, 8, 9, and 11 illustrate a state where the support member 63 is in a retracted position, and FIG. 10 illustrates a state where the support member 63 is in an advanced position. As will be described in detail later, although the support member 63 is displaced to an advanced position when the second tray 51 protrudes from the device main body 2, FIG. 11 illustrates a state where the support member 63 is in the retracted position for convenience.

Figure 12:
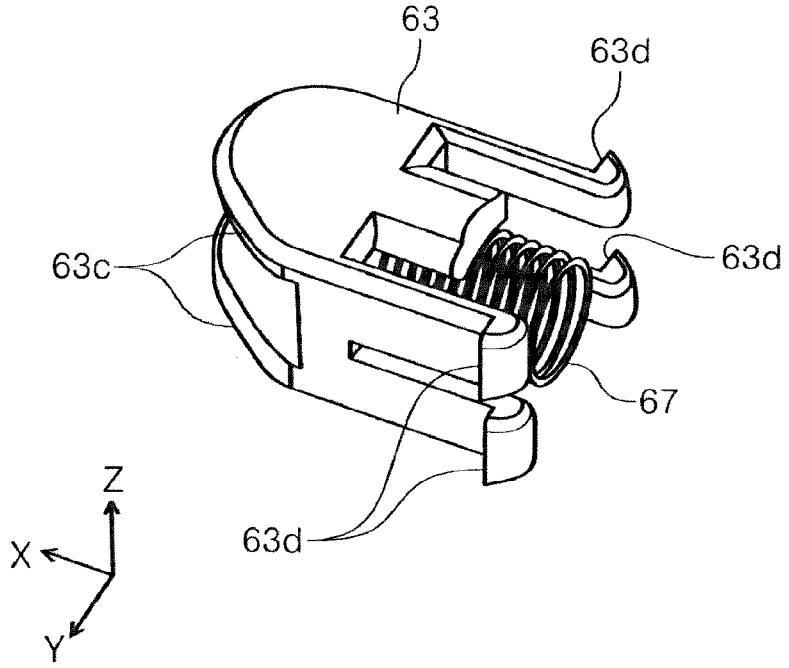
FIG. 12 is a perspective view of the support member and a coil spring.

As illustrated in FIG. 12, the support member 63 is pressed toward the side surface of the second tray 51 by a coil spring 67 which is an example of a pressing member. In the drawings other than FIG. 12, the illustration of the coil spring 67 is omitted.

Figure 8:
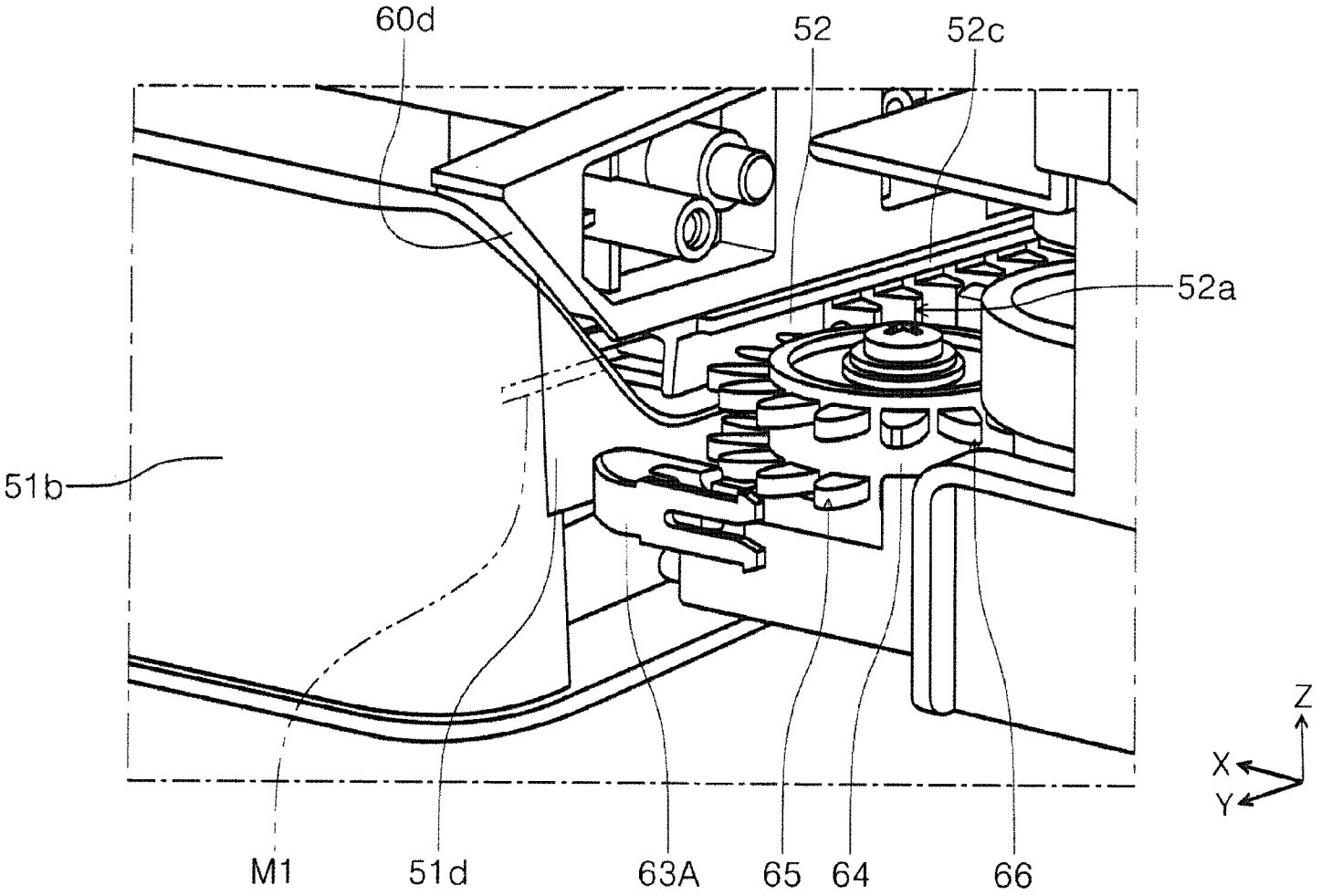
FIG. 8 is a perspective view of the accommodated discharge tray, the support member, and a driving object.

When the discharge tray 50 is in the first state, that is, when the second tray 51 is accommodated in the device main body 2, the support member 63 is in the retracted position, and is pressed against the side surface 51*d* of the second tray 51 by the spring force of the coil spring 67. This aspect is illustrated in FIG. 8.

Figure 9:
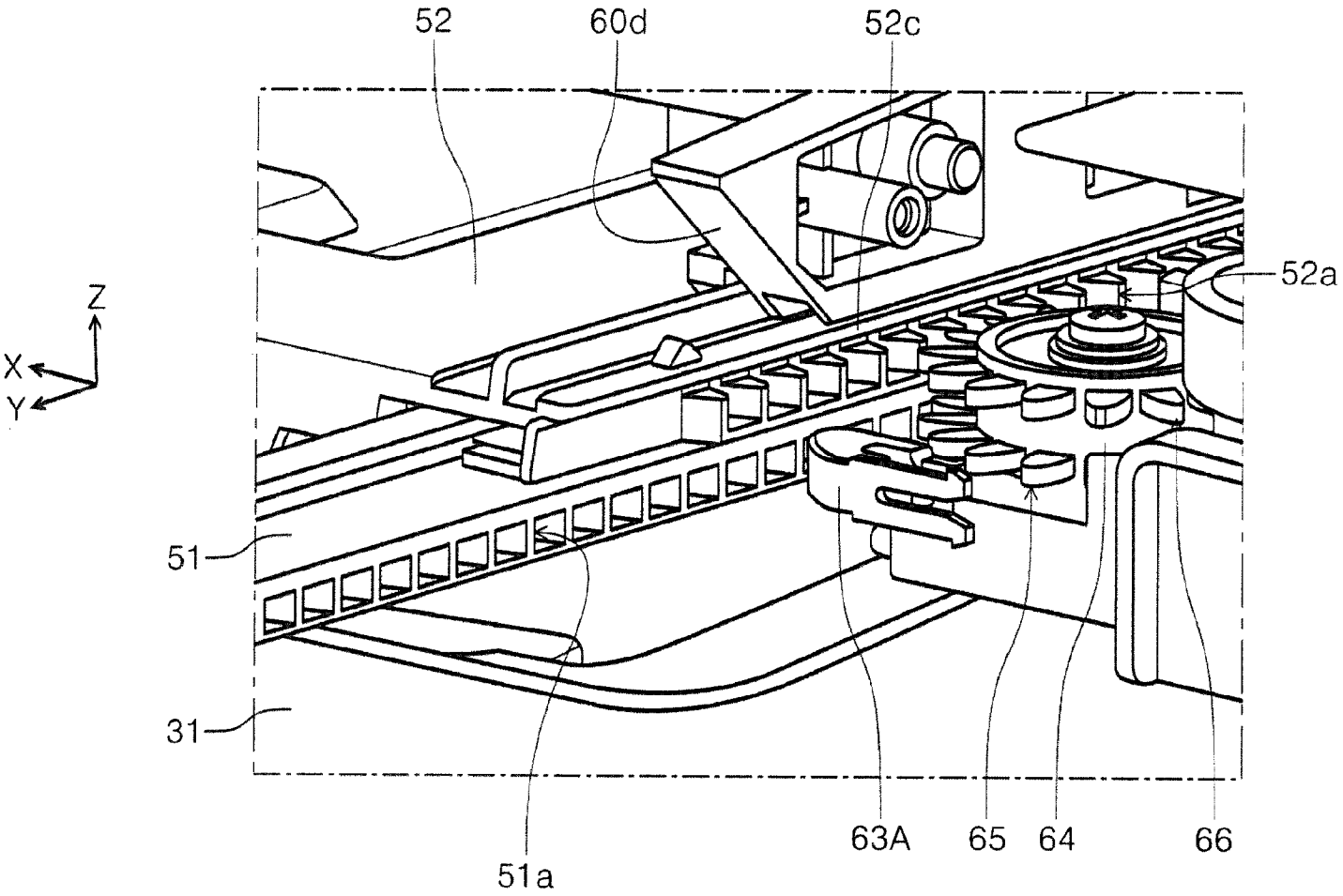
FIG. 9 is a perspective view of the discharge tray, the support member, and the driving object in a state of pulled out halfway.
Figure 10:
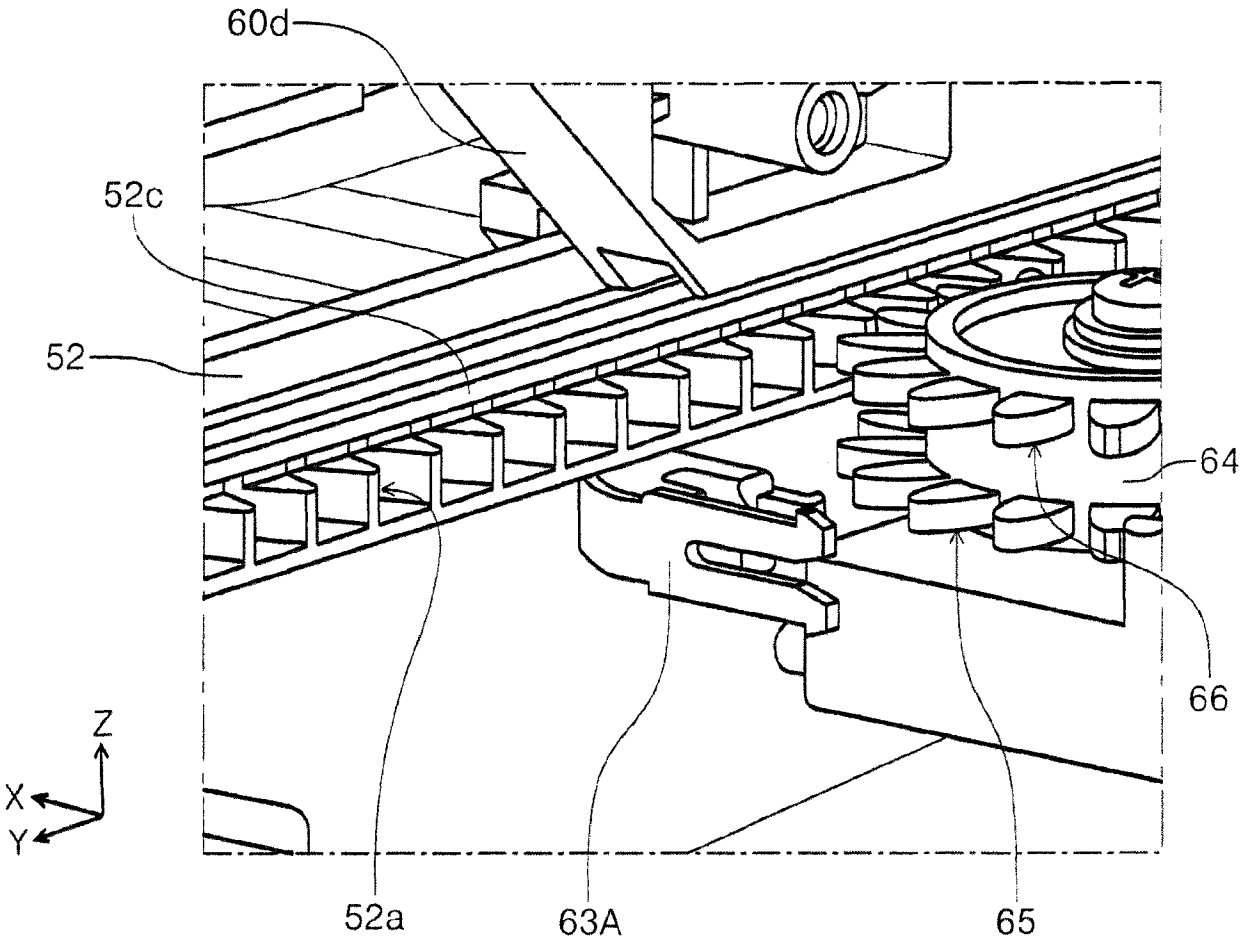
FIG. 10 is a perspective view of the discharge tray, the support member, and the driving object in a state of most pulled out.

When the discharge tray 50 switches from the first state to the second state from this state, as illustrated in the change from FIG. 9 to FIG. 10, the second tray 51 comes out of the region facing the support member 63, and the support member 63 is switched from the retracted position to the advanced position by a pressing force of the coil spring 67. As illustrated in FIG. 12, a hook 63*d* is formed on the support member 63. When the hook 63*d* is hooked on the rear side of the opening portion 60*c* (FIG. 5) of the frame 60, the advanced position of the support member 63 is defined.

On the contrary, when the discharge tray 50 is switched from the second state to the first state, the second tray 51 pushes the support member 63 against the pressing force of the coil spring 67, so that the support member 63 switches from the advanced position to the retracted position.

With such a configuration, the configuration for displacing the support member 63 can be configured at low cost.

In addition, since the support member 63 presses against the side surface 51*d* of the second tray 51 when the discharge tray is in the first state as illustrated in FIG. 8, rattling of the discharge tray 50 in the first state can be suppressed.

The support member 63 is positioned in the +Y direction than the end portion of the rail 60*a* in the +Y direction. When the discharge tray 50 is in the second state as illustrated in FIG. 10, the support member is at the advanced position to support the first tray 52 from below. As a result, the discharge tray 50 in the second state can be stably supported.

In addition, since the length of the rail 60*a* illustrated in FIGS. 5 and 11 extending in the +Y direction can be suppressed, it is not necessary to form a escape shape in the first tray 52 or the second tray 51, and an increase in cost accompanying the complexity of a structure can be suppressed.

In FIG. 8, a virtual line and reference numeral M1 indicate an escape shape, more specifically a groove, required for the side surface 51*d* of the second tray 51 when the rail 60*a* is further extended in the +Y direction from the length illustrated in FIG. 11. A range Ya illustrated in FIG. 11 illustrates an example of a length extending the rail 60*a*. When the rail 60*a* is further extended in the +Y direction from the length illustrated in FIG. 11, a escape shape as indicated by reference numeral M1 in FIG. 8 is required, and there is a possibility of increasing the cost accompanying the complexity of a structure. Although not preferable in appearance, such a problem can be avoided by providing the support member 63 as described above.

The support member 63 is formed with a slope 63*c* as illustrated in FIG. 12. The slope 63*c* is a surface pushed to the end portion of the second tray 51 in the −Y direction when the discharge tray 50 is switched from the second state to the first state. The slope 63*c* is formed by a surface that intersects the Y direction. Such a slope 63*c* can suppress the possibility that the second tray 51 is caught by the support member 63.

In addition, since the support members 63 are provided on both sides of the second tray 51, the first tray 52 can be supported more reliably and appropriately. However, the support member 63 may be provided only on one side surface of the second tray 51.

Subsequently, a mechanism for displacing the discharge tray 50 will be described.

The discharge tray 50 is configured to be displaced between the first state and the second state by receiving the power of a motor (not illustrated), thereby improving user convenience. In the present embodiment, a mechanism for displacing the discharge tray 50 is provided at a position facing one side surface of the discharge tray 50, specifically, in the −X direction with respect to the discharge tray 50.

A driving object 64 illustrated in FIGS. 9 to 11 is driven by a motor (not illustrated) and constitutes a portion of a drive unit driving the discharge tray 50.

The driving object 64 is provided with two pinion gear portions, and specifically is provided with a first pinion portion 66 that meshes with the first rack portion 52*a* of the first tray 52, and a second pinion portion 65 that meshes with the second rack portion 51*a* of the second tray 51.

When the driving object 64 rotates, the first tray 52 and the second tray 51 perform the displacement operations.

More specifically, in FIG. 8 illustrating the first state of the discharge tray 50, although the second pinion portion 65 is meshed with the second rack portion 51*a* of the second tray 51, the first pinion portion 66 does not mesh with the first rack portion 52*a* of the first tray 52. Therefore, when the driving object 64 starts to rotate from the state of FIG. 8, only the second tray 51 starts the displacement operation in the +Y direction at first, and the first tray 52 remains stopped.

Thereafter, when the second tray 51 protrudes by a predetermined amount, an abutting portion (not illustrated) of the second tray 51 abuts on the first tray 52, the first tray 52 is pulled in the +Y direction by the second tray 51, and as illustrated in FIG. 9, the first rack portion 52*a* of the first tray 52 meshes with the first pinion portion 66. As a result, thereafter, the first tray 52 is driven together with the second tray 51.

After the first tray 52 is driven and displaced by a predetermined amount, the second pinion portion 65 releases the meshing with the second rack portion 51*a* of the second tray 51 as illustrated in FIG. 10.

On the contrary, when the discharge tray 50 moves from the second state toward the first state, the first tray 52 and the second tray 51 supported by the first tray 52 are displaced in the −Y direction by the meshing of the first rack portion 52*a* of the first tray 52 and the first pinion portion 66. Eventually, the second pinion portion 65 meshes with the second rack portion 51*a* of the second tray 51, and thereafter the first pinion portion 66 releases the meshing with the first rack portion 52*a* of the first tray 52. As a result, subsequently the second tray 51 is displaced in the −Y direction and returns to the first state of the discharge tray 50 illustrated in FIG. 8.

Figure 4:
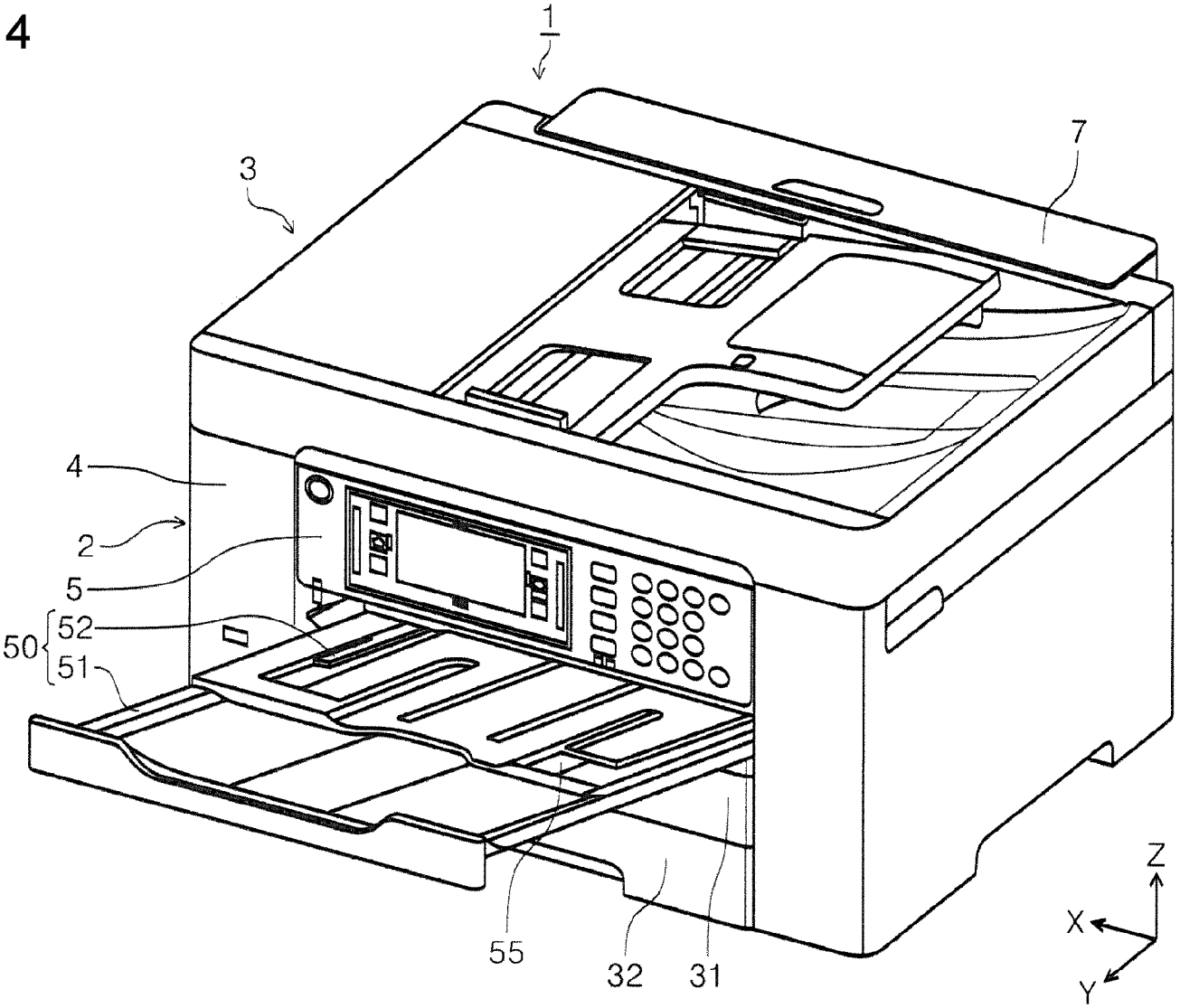
FIG. 4 is a perspective view of the printer in a state where the discharge tray is most pulled out.

In the present embodiment, the second state of the discharge tray 50 includes a first position illustrated in FIG. 3 and a second position that protrudes further than the first position as illustrated in FIG. 4. The first position is a position when, for example, A4 size sheet is discharged so that the longitudinal direction is along the Y axis direction, and the second position is a position when, for example, A3 size sheet is discharged so that the longitudinal direction is along the Y axis direction. A control portion (not illustrated) that controls a fourth motor (not illustrated) that is a power source of the discharge tray 50 positions the discharge tray 50 based on the sheet size information obtained from the driver information.

As described above, the support member 63 includes the first support member 63A on the side where the driving object 64 is provided and the second support member 63B on the side opposite to the side on which the first support member 63A is provided of both sides of the second tray 51. In this configuration, the coil spring 67 (refer to FIG. 12) that presses each support member may be different from the coil spring that presses the first support member 63A and the coil spring that presses the second support member 63B. Specifically, a coil spring that exerts a stronger spring force than the coil spring that presses the first support member 63A is adopted as the coil spring that presses the second support member 63B. When the discharge tray 50 is in the first state, the second tray 51 is configured to be pressed toward the driving object 64 (refer to FIG. 8). As a result, the meshing between the second rack portion 51*a* provided on the second tray 51 and the second pinion portion 65 can be appropriately maintained.

The present disclosure is not limited to the embodiment described above, various modifications are possible within the scope of the disclosure described in the aspects, and needless to say, these are also included in the scope of the present disclosure.

For example, the support member 63 may be configured to be advanced and retracted by an actuator such as a motor or a solenoid. In that case, it is preferable to provide a sensor for detecting the positions of the first tray 52 and the second tray 51.

What is claimed is:

1. A recording device comprising:

a device main body that includes a recording unit which records on a medium; and a medium receiving tray configured to switch between a first state in which the medium receiving tray is accommodated in the device main body and a second state in which the medium receiving tray protrudes from the device main body, and that receives the medium discharged toward an outside of the device main body in the second state or a state of protruding from the device main body toward the second state from the first state, wherein the medium receiving tray is configured to include a first tray configured to be displaced with respect to a rail provided in the device main body and a second tray configured to be displaced with respect to the first tray, the second tray further protruding from the device main body than the first tray in the second state and being supported by the first tray, the device main body includes at least one support member configured to be at an advanced position at which the support member advances with respect to a side surface of the medium receiving tray and a retracted position at which the support member retracts from the advanced position, the support member is at a position protruding from an end portion of the rail in a protruding direction of the first tray from the device main body, the support member is at the retracted position when the medium receiving tray is in the first state, and the support member is at the advanced position and supports the first tray from below when the medium receiving tray is in the second state.

2. The recording device according to claim 1, wherein the second tray is positioned below the first tray, the support member is pressed toward a side surface of the second tray by a pressing member, the support member is at the retracted position and presses against the side surface of the second tray, when the medium receiving tray is in the first state, the second tray is pulled out from a region facing the support member, and the support member is switched from the retracted position to the advanced position, when the medium receiving tray is switched from the first state to the second state, and the support member is switched from the advanced position to the retracted position by the second tray pushing the support member against a pressing force of the pressing member, when the medium receiving tray is switched from the second state to the first state.

3. The recording device according to claim 2, wherein a surface of the support member pressed by the second tray when the medium receiving tray is switched from the second state to the first state is formed by a surface intersecting a displacement direction of the second tray.

4. The recording device according to claim 1, wherein the support member is provided on each side of the second tray.

5. The recording device according to claim 2, further comprising:

a drive unit configured to displace the medium receiving tray and provided at a position facing one side surface of the medium receiving tray in the device main body, wherein the drive unit includes two pinion gears, the first tray includes a first rack portion that meshes with one pinion gear of the two pinion gears, the second tray includes a second rack portion that meshes with an other pinion gear of the two pinion gears, and the first tray and the second tray are displaced by a rotation of the two pinion gears.

6. The recording device according to claim 5, wherein the support member includes a first support member on a side on which the drive unit is provided of both sides of the second tray and a second support member on a side opposite from the side on which the first support member is provided, and the second support member presses the second tray with a pressing force stronger than a pressing force of the first support member, when the medium receiving tray is in the first state.

7. The recording device according to claim 1, wherein the medium receiving tray is configured to be pulled out from the device main body, the recording device further comprises:

a restriction unit configured to switch between a permission state in which the medium receiving tray is permitted to be pulled out from the device main body and a restriction state in which the pulling out from the device main body is restricted.

8. The recording device according to claim 7, wherein the restriction unit includes a restriction portion provided on the device main body, a restricted portion provided on the first tray and configured to switch between a state in which the restricted portion is configured to be engaged with the restriction portion and a state in which the restriction portion is not configured to be engaged with the restriction portion, and an operation portion, provided on the first tray, for switching the states of the restricted portion.

9. The recording device according to claim 7, further comprising:

a first medium transport path which is a medium transport path facing the recording unit, and configured to transport the medium in a first direction which is a medium transport direction when recording on the medium is performed and in a second direction opposite from the first direction;

a reverse path on which a surface of the medium is reversed;

a second medium transport path that guides the medium recorded by the recording unit to the reverse path;

a third medium transport path that is positioned below the second medium transport path, guides the medium on which recording is performed by the recording unit to the reverse path, and is different from the second medium transport path;

a path forming portion that forms a portion of a lower side of the third medium transport path, and is positioned above the medium receiving tray mounted on the device main body; and a medium storage cassette positioned below the medium receiving tray and configured to accommodate the medium and be detached from the device main body, wherein the path forming portion is configured to be displaced downward in a state where the medium receiving tray and the medium storage cassette are removed from the device main body, and a portion of the third medium transport path is exposed when the path forming portion is displaced downward.

10. The recording device according to claim 9, wherein the path forming portion is provided with an abutting portion on which the medium receiving tray abuts in a state where the path forming portion is displaced downward, and the medium receiving tray abuts on the abutting portion in a state where the path forming portion is displaced downward, so that the restriction unit is prevented from being switched to the restriction state.

* * * * *